US007234430B2

(12) United States Patent
Toedter et al.

(10) Patent No.: US 7,234,430 B2
(45) Date of Patent: Jun. 26, 2007

(54) METHOD FOR HEATING A GLOW PLUG FOR A DIESEL ENGINE

(75) Inventors: Olaf Toedter, Woessingen (DE); Heinz-Georg Schmitz, Marbach/Neckar (DE); Andreas Bleil, Ludwigsburg (DE); Joerg Stoeckle, Ludwigsburg (DE); Hans Houben, Wuerselen (DE)

(73) Assignee: Beru AG, Ludwigsburg (DE)

( * ) Notice: Subject to any disclaimer, the term of this patent is extended or adjusted under 35 U.S.C. 154(b) by 67 days.

(21) Appl. No.: 10/965,809

(22) Filed: Oct. 18, 2004

(65) Prior Publication Data

US 2005/0081812 A1 Apr. 21, 2005

(30) Foreign Application Priority Data

Oct. 17, 2003 (DE) ..... 103 48 391

(51) Int. Cl.
*F02N 17/00* (2006.01)
*F02N 17/04* (2006.01)

(52) U.S. Cl. ..... 123/179.6; 123/179.21; 219/270; 219/492

(58) Field of Classification Search ..... 123/179.21, 123/179.17, 605, 179.6, 145 R, 145 A; 219/270, 219/497, 544, 492, 494, 490
See application file for complete search history.

(56) References Cited

U.S. PATENT DOCUMENTS 4,566,410 A 1/1986 Demizu
4,607,153 A * 8/1986 Ang et al. ..... 219/497
4,639,871 A * 1/1987 Sakai et al. ..... 701/113
4,658,772 A 4/1987 Auth et al.
4,669,430 A * 6/1987 Reinold et al. ..... 123/179.6
4,821,690 A * 4/1989 Masaki ..... 123/179.21
5,469,819 A 11/1995 Berger et al.
5,570,666 A * 11/1996 Rymut et al. ..... 123/145 A
6,148,258 A 11/2000 Boisvert et al.
6,637,392 B2 10/2003 Jung
6,712,032 B2 3/2004 Uhl et al.
6,736,098 B2 5/2004 Toedter et al.
2004/0118828 A1 6/2004 Toedter et al.
2005/0039732 A1 * 2/2005 Toedter et al. ..... 123/605

FOREIGN PATENT DOCUMENTS

DE 100 25 953 A1 12/2001
DE 100 34 529 A1 1/2002

OTHER PUBLICATIONS

The Electronically Controlled ISS Glow System for Diesel Engines, MTZ MotorTechnische Zeitschfrift 61, Oct. 2000, pp. 668-675.

* cited by examiner

*Primary Examiner*—Carl S. Miller
(74) *Attorney, Agent, or Firm*—David S. Safran

(57) ABSTRACT

A method for heating a glow plug for a diesel engine to its desired temperature by supplying power to the glow plug in a controlled fashion. During a certain time interval after termination of a previous glow process, a mathematical model is used to determine the values for the supply of power to the glow plug, which includes the values of the actual thermal state of the glow plug, the time elapsed since the end of the previous glow process and the parameters of the diesel engine relevant for a glow process.

3 Claims, 1 Drawing Sheet

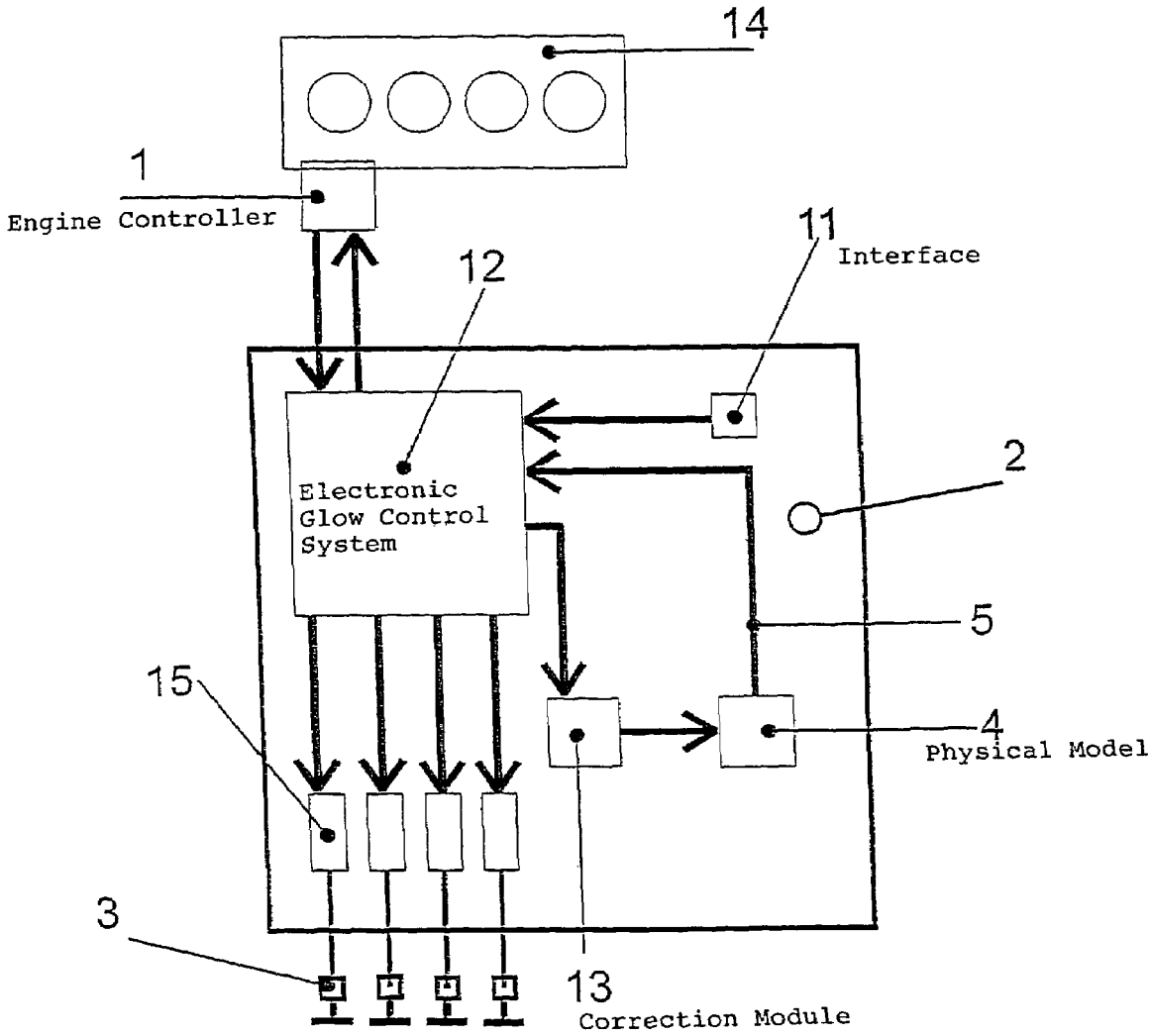
14
1
Engine Controller
11
Interface
12
Electronic
Glow Control
System
2
5
15
4
Physical Model
3
13
Correction Module

METHOD FOR HEATING A GLOW PLUG FOR A DIESEL ENGINE

BACKGROUND OF THE INVENTION

1. Field of the Invention

The invention relates to a method for heating a glow plug for a diesel engine to a desired or set temperature, by passing current through the glow plug in a controlled manner.

2. Description of Related Art

A method of the above noted type is used to bring a glow plug of a diesel engine up to the set temperature at which the engine can be started.

A method for controlling the heating-up of a glow plug for a diesel engine is known from MTZ 10/2000 "The electronically controlled ISS glow system for diesel engines", in which the glow command or the glow request is given after initialization of the engine control system has been completed, after the temperature of the engine elements has been determined via the engine control system and communication has then been successfully set up between the engine control system and the glow controller.

In order to control the heating-up of a glow plug of a diesel engine, it is important to know the thermal state of the glow plug, especially in the case of a quick-start glow plug, for example, the residual temperature of the glow plug after a previous glow process during a re-start, and to incorporate it in the subsequent control.

A quick-start glow plug which is designed so that its nominal voltage lies far below the available supply voltage in order to achieve a short heat-up time and which, for example, is designed for a voltage of 5 V in order to achieve an inertia temperature of 1000° C. at a supply voltage of 12 V, has hitherto been operated such that the resistance of the glow plug is checked before initiating the quick-glow phase in order to determine any glow process which may have taken place previously. If an already hot glow plug is heated, it can be damaged by excess temperature. Thus, for safety reasons, if a hot glow plug is identified, for example, in the event of a re-start, this is only acted upon with a low voltage, e.g., the nominal voltage, in order to avoid any overheating. However, this has the disadvantage that this following glow process takes place very slowly so that the glow plug requires a very long time to reach the desired temperature. For example, if the ignition key is actuated twice in quick succession, the pre-glow phase of the second pre-glow process requires about 10 seconds as compared with a value of 2 seconds in the first glow attempt in order to reach the same temperature.

SUMMARY OF THE INVENTION

A primary object of the present invention is thus to provide a method of the type specified initially which avoids overheating of the glow plug in the event of a re-start and nevertheless brings the glow plug to the desired temperature in the shortest time.

This object is solved according to the invention by a method for heating a glow plug for a diesel engine to its set temperature by supplying power to the glow plug in a controlled fashion such that, during a certain time interval after termination of a glow process, a mathematical model is used to determine the values for the supply of power to the glow plug, which includes the values of the actual thermal state of the glow plug, the time elapsed since the end of the glow plug process and the parameters of the diesel engine relevant for a glow process In the method according to the invention, improved re-start protection is provided, e.g., in the case of a quick-start glow plug or a low-voltage glow plug, it is possible to use pre-emptive control and it is also possible to heat up the glow plug as quickly as possible even in re-starts taking into account the energy still contained therein.

For this purpose, the actual thermal situation of the glow plug is taken into account by including this in the mathematical model and using the mathematical model to determine, as a function of the previous history, i.e., one or a plurality of preceding glow processes and the intervening intervals, the current which needs to be passed and is allowed to be passed through the glow plug to bring the glow plug to the desired temperature as quickly as possible without risking overheating.

Thus, after a glow process has been completed, the glow control system is not switched off, but is operated further over a certain time by, for example, external or internal voltage maintaining. This time is, for example, the time interval which must elapse before a glow plug which has already previously been heated, can have the total energy input passed through it again without any danger.

Each glow process is recorded and stored with its relevant input quantities for the mathematical model. These quantities are input to the model and made available. Also included in the model are the elapsed interval, i.e., the time since the last glow process without current flowing through the glow plug and the relevant parameters for a glow process, for example, the state of the diesel engine such as the speed, the temperature, the injection quantity etc., which are recorded and either stored in analog form or made available directly to the model. Using these parameters, the model then calculates the permissible and necessary energy input to bring the glow plug up to the desired temperature again in the shortest possible time or the optimal time for the glow plug without there being any risk of overheating.

An especially preferred exemplary embodiment of the invention is explained in detail below with reference to the accompanying drawings.

BRIEF DESCRIPTION OF THE DRAWINGS

The sole FIGURE of the drawings shows a schematic circuit diagram of a control device for implementing the method according to the invention.

DETAILED DESCRIPTION OF THE INVENTION

The control device shown in the drawing comprises an engine controller 1 and a glow controller 2 at which a glow request from the engine controller 1 is applied via a suitable interface. The glow controller 2 interprets the glow request and passes current through the glow plug 3 accordingly.

A physical model 4 of the glow plug is provided in the glow controller 2 which is controlled parallel to the glow plug 3 so that the thermal state of the glow plug 3 is depicted by this physical model 4. The physical model 4 is designed so that at least when the engine is not running, i.e., without gas change or fueling, it accurately depicts the temperature of the heating rod tip of a conventional glow plug. This applies both to the heating up and to the cooling down of the glow plug.

The resistance of a suitably dimensioned PTC or NTC element within the physical model 4, for example, can serve as a measure for the thermal state of the glow plug. Instead of this, an electrical storage device can also be used whose charging state correlates with the thermal state. The thermal state of the physical model 4 is evaluated and is available as input quantity 5 at the glow plug control system 12.

Using the physical model 4 which is implemented in the glow controller 2, the dynamics of the glow plug 2 is registered so accurately that accurate information on the temperature actually present at the glow plug 3 is given.

The accuracy can be further increased by comparing the temperature of the physical model 4 with a further temperature which is recorded at a position which reflects the ambient temperature. This can, for example, be a measurement point at the stamped metal grid which does not carry any large current (interface/communication 11). In the case of the physical model 4, which is implemented in the glow controller 2, the model or the integrated electronic components can easily be balanced during manufacture whereby the accuracy is further increased.

The evaluation of the resistance of the glow plug 3 by measurement of the current is certainly insufficient to measure the temperature, especially in dynamic phases, but in sufficiently stationary phases the resistance of the glow plug 3 can be compared with the values of the physical model 4 and the accuracy can thereby be increased or the plausibility checked. A corresponding functionality in the glow controller 2 for specific balancing between the glow plug resistance and the output of the physical model 4 can be easily implemented in the glow controller 2 by corresponding software and storage devices in the electronic glow control system 12.

The state of the physical model 4 is evaluated by suitable electronics and is available as a signal for re-processing for the glow control system 12.

The physical model 4 is thus operated parallel to the glow plug 3 so that it experiences an equivalent or proportional energy input and simulates the heating-up behavior of the glow plug 3. The simulation is matched so that the heating-up and cooling-down behavior is simulated when the engine is stationary.

However, the physical model 4 in the glow controller 2 does not experience the energy inflow or energy outflow which occurs at a glow plug in the combustion chamber as a result of the combustion energy or the additional cooling as in thrust operation, for example. In order that the physical model 4 fulfills its purpose and simulates the temperature of the glow plug 3 as well as possible, in addition to the parallel control of the physical model 4, the additional positive or negative energy input by external influences which deviates from the standard case is thus also taken into account mathematically. For this purpose, a correction module 13 is provided, for example, which takes into account the actual engine state, for example, its speed, its torque, the injected quantity and temperature, etc., and accordingly, modifies the control of the physical model 4 so that the glow plug temperature output by the physical model 4 shows good agreement with the actual up-date temperature of the glow plug.

In the simplest case, the control is limited with a fixed value. For example, it is known that during operation of the engine, at least in direct-injection diesel engines, except in the boundary region of low speed and under very high load, a higher energy requirement is required as compared with the stationary engine to maintain the glow plug at the desired temperature. Usually, the glow control system 12 will regulate the energy supply to the glow plug 3 so that the glow plug temperature is kept constant regardless of the engine operating conditions. Thus, when the engine is running, and consequently, when the energy flow to the glow plug 3 is usually higher than when the engine is stationary, it can be assumed that the glow plug 3 has exactly reached the desired temperature. The physical model 3 can thus be forced to the state corresponding to the desired temperature by the correction module 13 for these cases which are simple to record.

If a more accurate image of the actual glow plug temperature or the energy content is required by the physical model 4 or, for example, in the case of indirect-injection engines or other engines in which the above-mentioned simple limitation of the model by a fixed value is not sufficient, the additional positive or negative energy input is recorded by measurement technology and set in correlation to the parameters available in the engine controller 1 or the glow controller 2, such as, for example, the injection quantity, the speed, the internal torque, the air, engine, water or oil temperature. An algorithm is compiled on the basis of the data obtained and integrated into the correction module 13 which modifies the control signal for the physical model 4 parallel to the passage of current through the glow plug such that the physical model 4 follows the actual temperature of the glow plug as accurately as possible. In this way, the temperature of the glow plug can be controlled with a closed control loop being formed by recording the temperature of the physical model 4. Overstressing, control errors, etc. can thereby be avoided. A desired temperature sent, for example, by the engine controller 1 to the glow controller 2 can then be converted and monitored relatively simply wherein the attainment of this temperature can then be fed back to the engine controller 1.

As a result of this regulation, it is moreover possible to bring the glow plug 3 more quickly up to the desired temperature since the energy input required for this is accurately known on the basis of the physical model 4 of the glow plug and its software implementation. Thus, it is not necessary to allow only a slower heating-up rate as is conventionally the case so that safety is increased because of the lack of feedback of the resulting temperature to the glow plug 3.

What is claimed is:

1. A method for reheating a glow plug for a diesel engine to a set temperature, comprising the steps of:

using a mathematical model during a certain cooling down time interval after termination of a glow process to determine values for the supply of power to the glow plug, said model including values of the actual thermal state of the glow plug, the time elapsed since the end of the terminated glow plug process and parameters of the diesel engine relevant for a glow process; and supplying power to the glow plug in a controlled fashion based upon said determined values;

mathematical model is comprised of a set of variables and at least one equation that establishes relationships between the variables, the variables including the actual thermal state of the glow plug, the time elapsed since the end of the terminated glow plug process and parameters of the diesel engine relating to the glow process with the relationship of the variables defining the manner in which power is to be supplied to the glow plug.

2. The method according to claim 1, wherein the certain time interval is the time which must elapse after the end of a previous glow process before full power can be supplied to the glow plug without there being a risk of overheating.

3. The method according to claim 1, wherein the actual thermal state of the glow plug is determined using a physical model of the glow plug to which power is supplied parallel to the glow plug.

* * * * *